US007338274B2

(12) United States Patent
Vilo

(10) Patent No.: US 7,338,274 B2
(45) Date of Patent: Mar. 4, 2008

(54) PANEL PRESS

(75) Inventor: Jaakko Vilo, Turku (FI)

(73) Assignee: Raute Oyj, Nastola (FI)

( * ) Notice: Subject to any disclaimer, the term of this patent is extended or adjusted under 35 U.S.C. 154(b) by 15 days.

(21) Appl. No.: 11/401,867

(22) Filed: Apr. 12, 2006

(65) Prior Publication Data

US 2006/0233905 A1 Oct. 19, 2006

(30) Foreign Application Priority Data

Apr. 13, 2005 (FI) ..... 20050380

(51) Int. Cl.
*B30B 5/06* (2006.01)

(52) U.S. Cl. ..... 425/371; 425/405.1; 100/154

(58) Field of Classification Search ..... 425/371, 425/405.1; 100/154
See application file for complete search history.

(56) References Cited

U.S. PATENT DOCUMENTS 2,135,763 A * 11/1938 Nicholson ..... 100/154
3,981,666 A * 9/1976 Wadman ..... 425/371
4,285,525 A * 8/1981 Held ..... 100/154
4,311,550 A 1/1982 Kerttula
4,365,548 A * 12/1982 Pankoke ..... 425/371
4,419,062 A * 12/1983 de Mets ..... 425/371
4,485,733 A * 12/1984 Held ..... 425/371
4,541,889 A * 9/1985 Held ..... 425/371
4,645,632 A * 2/1987 Bottger et al. ..... 425/371
4,802,837 A * 2/1989 Held ..... 425/371
4,921,569 A 5/1990 Held

FOREIGN PATENT DOCUMENTS

FI 72917 B 4/1987
FI 1873989 3/1989

* cited by examiner

*Primary Examiner*—James P. Mackey
(74) *Attorney, Agent, or Firm*—Young & Thompson

(57) ABSTRACT

A pressing apparatus for continuous pressing of panels, which apparatus consists of two pressure chambers juxtaposed with a vertical clearance. Each of the chambers occupying a platen in a sealed sliding contact to the vertical inner side walls of the chamber. The mutual distance of the platens define the clearance. A transport band is in sliding contact to the platen of each chamber. The chambers are pressurized. The platen edges in contact with the band are provided with a seal having a protrusion directed towards the middle area of the platen, and means are provided to exert and maintain a pressure in the volume defined by the platen, the band and the seal.

4 Claims, 4 Drawing Sheets

PANEL PRESS

Figure 1:
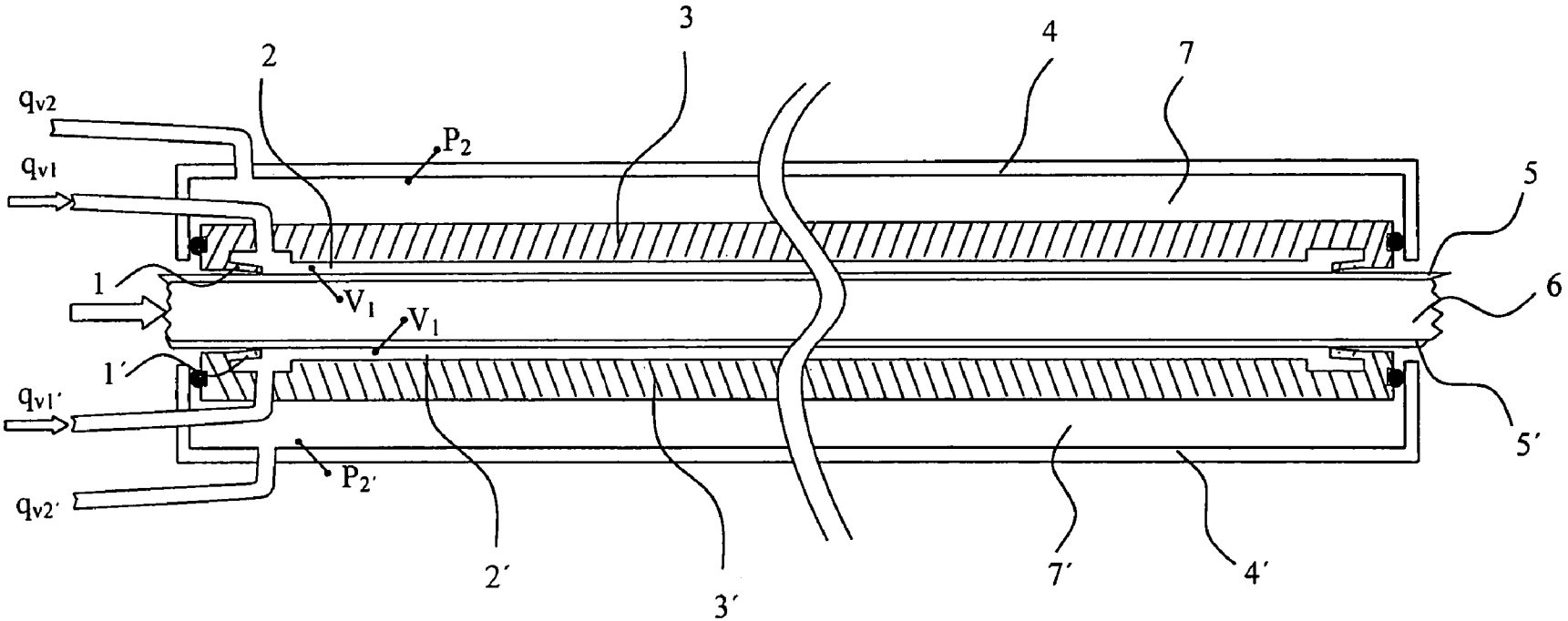

The present invention concerns a pressing apparatus, used for pressing of panel products as a continuous operation. For said purposes apparatuses are known which operate in a continuous manner, receiving the product to be pressed between two transport bands. Each band is sliding on one of the two facing press platens. The press platens may be solid, non bendable and optionally furnished with heating means, depending on the application of the press. The pressing force applied to non bendable press platens is usually exerted by hydraulically or pneumatically operated cylinder-piston devices. The transport bands are commonly of metallic construction.

Continuously operating press constructions are also known where press medium exerts the pressing force directly to the press platens. In these constructions the press platens are situated in a chamber divided horizontally into two halves each occupying a press platen in sealed sliding contact with the vertical inner walls of the respective chamber half. A space is reserved between the facing press platens for transport bands sliding on the facing press platen surfaces, as well as for the object to be pressed, the object being transported through the press between the bands. The press platens may be of a proper plastic or composite material. The bands transporting the object to be pressed are also of a proper plastic material. Selecting the materials for the elements properly, the presses can be suited for applications using micro-wave energy for heating the object to be pressed.

A problem encountered in these press apparatuses is the sliding contact of the transport bands against the press platens under the pressing conditions. The friction between the parts sliding relative to each other can be diminished with selecting the materials properly for the parts, but the problem is still essential.

It is also previously known to direct the pressing force directly to the transport bands in a continuously operating press. These press constructions include a pressure chamber on the pressure side of each band. A compressing air pressure is maintained in these chambers. The transport band closes one side of its pressure chamber. The closing is secured with a seal surrounding the edges of the closed chamber side. The seal is a dragging seal contacting the transport band. A controlled pressure is maintained behind the seal for urging the seal against the transport band. In order to minimize the friction between the seal and the transport band, a lubricating air flow is supplied into the space between the seal and the band. For maintaining the required sealing contact the apparatus is to be furnished with a separate pressure source, the pressure of which is to be regulated higher than the pressure prevailing in the ordinary pressing chamber, for securing a sufficient sealing effect between the transport band and the seal gliding on it.

In the pressing apparatus according to the invention the pressing operation itself as well as the operations required to maintain the operation can be accomplished more efficient and simple than in the pressing apparatuses disclosed in the prior art.

The pressing apparatus of the invention consists of two pressure chambers juxtaposed with a vertical clearance, the chambers occupying each a platen in a sealed sliding contact to the vertical inner side walls of the chamber for defining the clearance, two transport bands each encircling one of the pressure chambers in sliding contact to the platen of the chamber, and means for pressurizing the pressure chambers. The platen edges being in contact with the band are provided with a seal having a protrusion directed towards the middle area of the platen, and means are provided to exert and maintain a pressure in the volume defined by the platen, the band and the seal.

Figure 2:
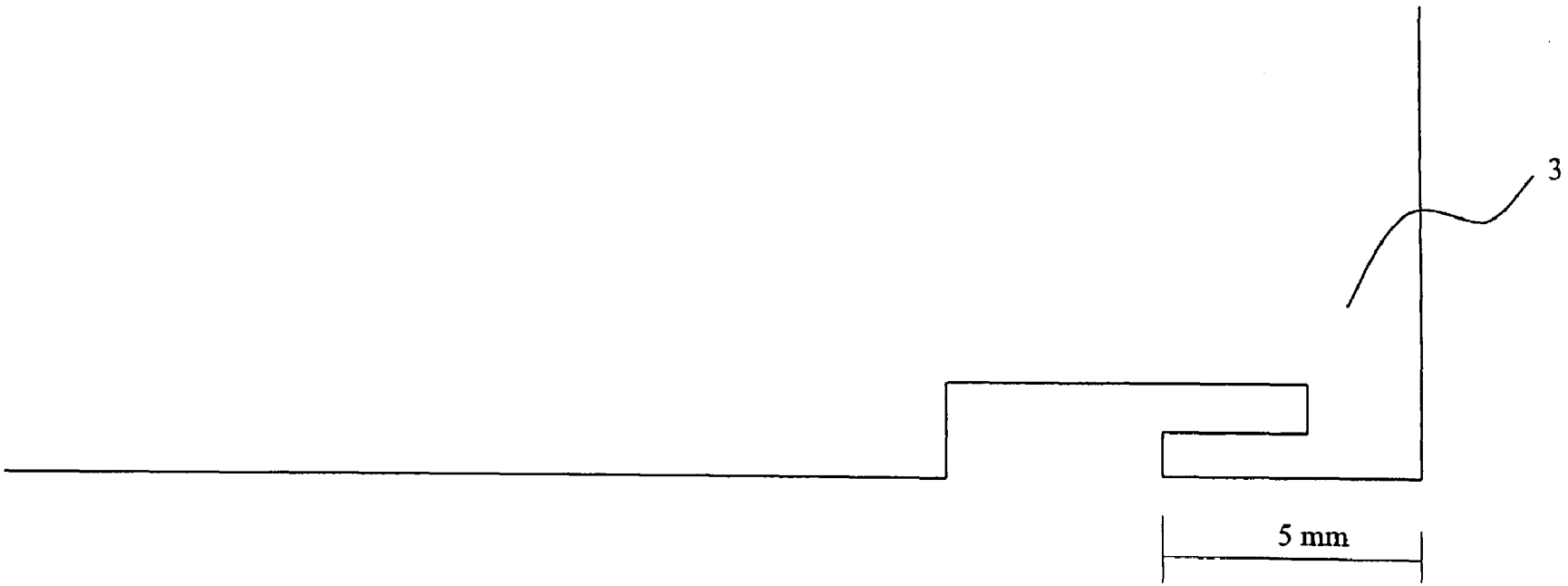
Figure 3:
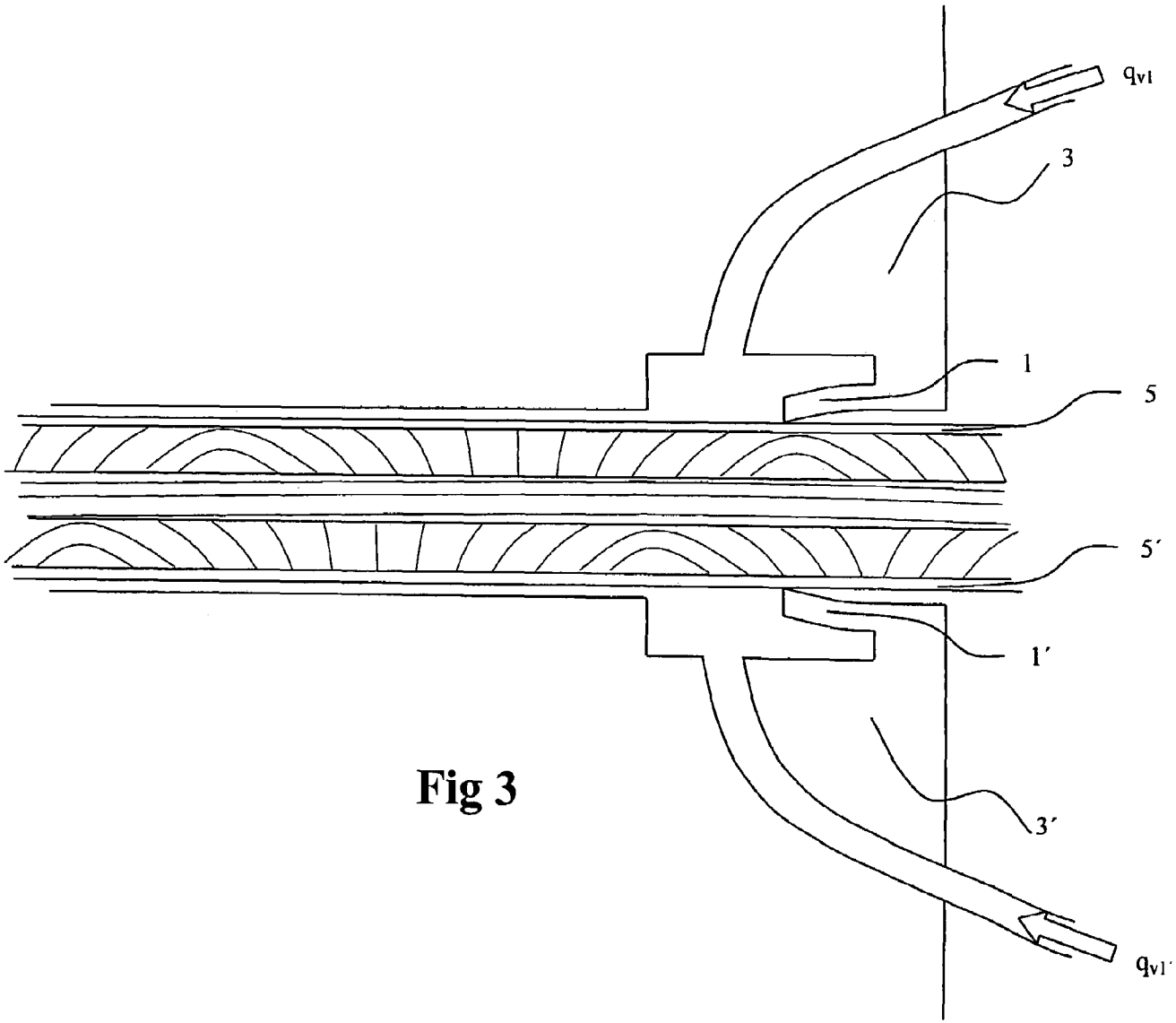
Figure 4:
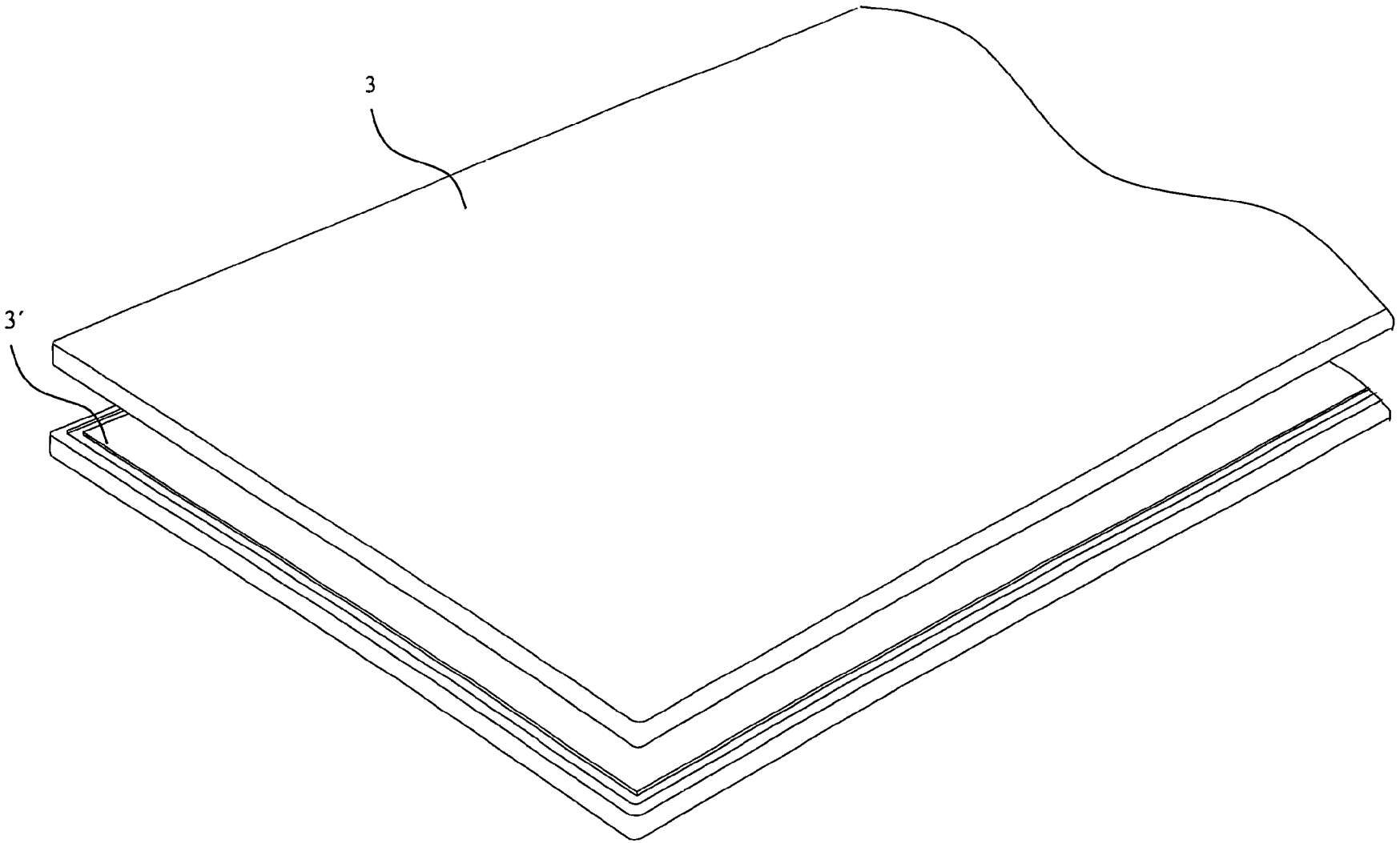

The press construction according to the invention will be explained more detailed referring to the attached drawing, where, FIG. 1 is a cross sectional view of a press according to the invention, FIG. 2 is a detailed representation of one embodiment for the edge area of a press platen used in the press of the invention, FIG. 3 is a detailed representation of the edge area of a press according to the invention, and FIG. 4 is a general layout of the platens in a press according to the invention.

In the illustration of FIG. 1 is schematically drafted a press in cross section, where the product 6 to be pressed is advancing between the bands 5 and 5' in the direction represented by the arrow through the press gap formed between the press platens 3 and 3'. The press platens 3 and 3' are in their own pressure chambers 4 and 4', which chambers can be pressurized with pressure P2, P2' in order to urge the press platens towards each other. The pressing movement is made possible by assembling the platens 3 and 3' in the chambers with a sliding contact to the vertical walls of the chambers. The press platens 3 and 3' may be of a substantially thin construction, because the pressure prevailing in the chambers 7 and 7' loads the platens evenly.

In order to accomplish the invention, on the pressing side of each of the platens 3 and 3' is formed a flat pool-like pressure volume $V_1$, $V_1'$, surrounded by a lip-seal 1, 1' along the edges of the platens. The press platens include further feed channels for medium feeds $q_{V1}$, $q_{v1}'$. The medium feed may consist of a liquid or a gas, mainly air to avoid any environmental problems. The lip-seal 1, 1' is formed to bend away from the press platen under pressure in the volume between the press platen 3 and the band 5, as well as the platen 3' and the band 5', respectively. The bending urges the lip into a sliding contact with the band mainly with its outer edge area. The area in sliding contact remains thus small, and the wear of the seal is minimized.

The pressure in volumes $V_1$, $V_1'$ is adjusted essentially to the same as the pressure $P_2$, $P_2'$ loading the platens 3 and 3' in the pressure volumes 7 and 7'. A leakage under the seals 1 and 1' is allowed during the operation of the press for lubrication the seals against the bands 5, 5', which leakage is compensated with the feeds $q_{v1}$, $q_{v1}'$.

The seals 1, 1' can be made as separate seals to be fastened to the edges of the platens 3, 3', whereby the change of a worn seal is easy. Another possibility is to make the press platens to include already the seals on the edges of the platens. This alternative mode is applicable when the platens are made of a plastics material. Polyethylene is one recommended material for the platens 3, 3'. The seal may also be of the type furnished with a nose, and turnable on a seat on the platen, whereby the nose is directed to the middle area of the platen.

The platens 3 and 3' form a good support and fastening base for the seals 1, 1' keeping the seals in proper form. The platens secure also that the compressing pressures are deviated evenly over the whole pressing area. The movements of the seals in the pressing direction are also evenly controlled over the pressure area, and any local deviation in the seal movements is excluded, which deviation would cause a higher local leakage between the platens 3, 3' and the bands 5, 5'.

The invention claimed is:

1. A pressing apparatus for continuous pressing of panels, which apparatus consists of two pressure chambers juxtaposed with a vertical clearance and having vertical inner side walls, a platen provided in each chamber in a sealed sliding contact with the vertical inner side walls of the chamber, two transport bands each encircling one of the pressure chambers in sliding contact with the platen of the chamber, and first means for pressurizing the pressure chambers, wherein platen edges in contact with the band are provided with a seal having a protrusion directed towards an area of the platen surrounded by the seal, and second means are provided to exert and maintain a pressure in the volume defined by the platen, the band and the seal.

2. The pressing apparatus of claim 1, wherein the protrusion of the seal is formed with a bendable lip.

3. The pressing apparatus of claim 1, wherein the pressing platens are of a plastic material, and the seal is formed as a part of the edge of the platen.

4. The pressing apparatus of claim 3, wherein the platens are made of polyethylene.

* * * * *